US010930127B2

(12) United States Patent
Favier

(10) Patent No.: US 10,930,127 B2
(45) Date of Patent: Feb. 23, 2021

(54) ELECTRONIC ARTICLE SURVEILLANCE LABELS

(71) Applicant: All-Tag Corporation, Boca Raton, FL (US)

(72) Inventor: Alain Favier, Paris (FR)

(73) Assignee: All-Tag Corporation, Boca Raton, FL (US)

( * ) Notice: Subject to any disclaimer, the term of this patent is extended or adjusted under 35 U.S.C. 154(b) by 0 days.

(21) Appl. No.: 16/264,013

(22) Filed: Jan. 31, 2019

(65) Prior Publication Data

US 2019/0244501 A1 Aug. 8, 2019

Related U.S. Application Data

(60) Provisional application No. 62/626,536, filed on Feb. 5, 2018.

(51) Int. Cl.

| | |
|---|---|
| ***G08B 13/14*** | (2006.01) |
| ***G08B 13/24*** | (2006.01) |
| ***G09F 3/18*** | (2006.01) |
| ***G09F 3/10*** | (2006.01) |
| ***G09F 3/03*** | (2006.01) |

(52) U.S. Cl.

CPC ..... *G08B 13/2434* (2013.01); *G08B 13/2442* (2013.01); *G09F 3/0335* (2013.01); *G09F 3/10* (2013.01); *G09F 3/185* (2013.01)

(58) Field of Classification Search

None

See application file for complete search history.

(56) References Cited

U.S. PATENT DOCUMENTS

| | | | | |
|---|---|---|---|---|
| 4,577,426 | A * | 3/1986 | Jenkins | G09F 3/0286 283/79 |
| 6,433,686 | B1 * | 8/2002 | Feibelman | G09F 3/14 340/568.1 |
| 7,247,214 | B2 * | 7/2007 | Chamandy | G06K 19/027 156/249 |
| 2002/0118633 | A1 * | 8/2002 | Weber | G11B 23/40 720/729 |
| 2002/0135481 | A1 * | 9/2002 | Conwell | G06K 19/073 340/572.1 |
| 2002/0180603 | A1 * | 12/2002 | Lyle | G06K 19/005 340/572.9 |
| 2004/0069847 | A1 * | 4/2004 | Kolton | G08B 13/248 235/383 |
| 2007/0158293 | A1 * | 7/2007 | Andreani | G08B 13/2402 215/12.1 |
| 2007/0194927 | A1 * | 8/2007 | Peter | G08B 13/2408 340/572.5 |
| 2007/0238245 | A1 * | 10/2007 | Cote | G06K 19/07718 438/243 |
| 2008/0061140 | A1 | 3/2008 | McMahon | |

(Continued)

*Primary Examiner* — Julie B Lieu

(74) *Attorney, Agent, or Firm* — Breiner & Breiner, L.L.C.

(57) ABSTRACT

There is disclosed an electronic article surveillance label and a cover label for an electronic article surveillance label for small high value hard goods such as, but no limited to, cosmetics, perfumes, medication, health-care items, DIY accessories and the like. The electronic article surveillance label and cover label include a flexible support having a bottom section with a soft glue area and a top section with a strong glue area.

20 Claims, 7 Drawing Sheets

(56) References Cited

U.S. PATENT DOCUMENTS

| | | | | |
|---|---|---|---|---|
| 2008/0084307 | A1* | 4/2008 | Peter | G08B 13/2408 340/572.1 |
| 2008/0136571 | A1* | 6/2008 | Peter | G08B 13/2408 335/306 |
| 2009/0194210 | A1 | 8/2009 | Montross | |
| 2009/0195386 | A1* | 8/2009 | Peter | G08B 13/2408 340/572.1 |
| 2010/0001079 | A1 | 1/2010 | Martin et al. | |
| 2010/0102968 | A1* | 4/2010 | Bulson | G08B 13/2408 340/572.8 |
| 2011/0215157 | A1 | 9/2011 | Ho et al. | |
| 2017/0004741 | A1* | 1/2017 | Maltas | G09F 3/205 |
| 2017/0073549 | A1 | 3/2017 | Croll et al. | |
| 2017/0193776 | A1* | 7/2017 | West | G08B 13/2437 |

* cited by examiner

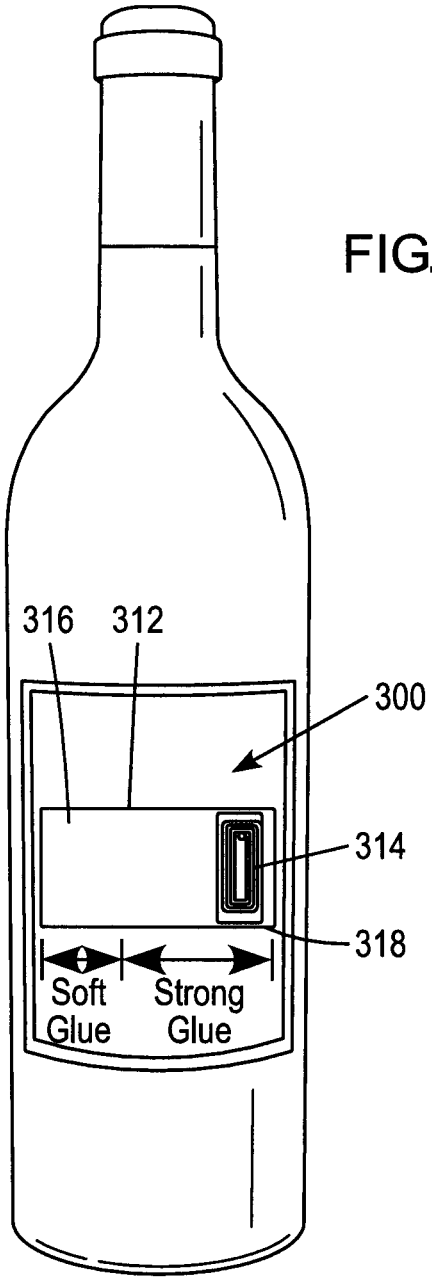
FIG. 8
FIG. 7
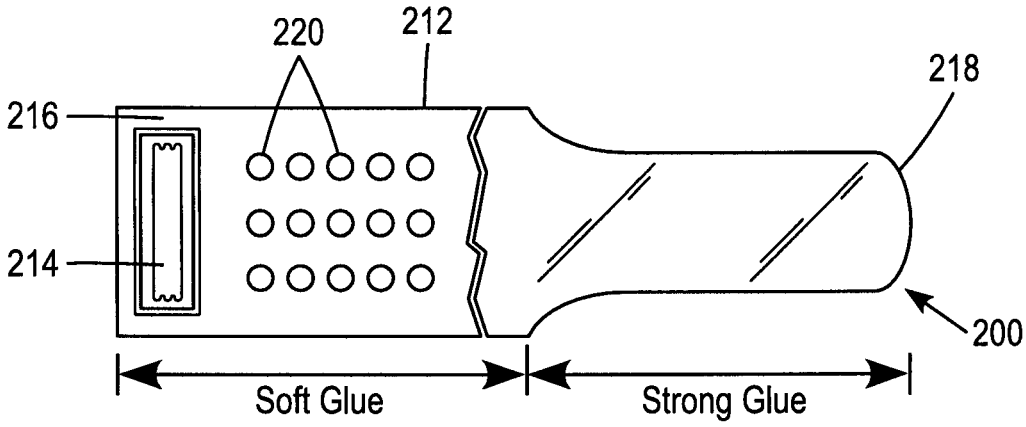

ELECTRONIC ARTICLE SURVEILLANCE LABELS

RELATED APPLICATION

This application claims benefit of U.S. Provisional Application Ser. No. 62/626,536, filed Feb. 5, 2018, entitled "Electronic Article Surveillance Labels," which application is incorporated herein by reference in its entirety.

FIELD OF THE INVENTION

The present invention relates to electronic article surveillance labels. More particularly, the invention relates to an electronic article surveillance label and a cover label for an electronic article surveillance label for small high value hard goods such as, but no limited to, cosmetics, perfumes, medication, health-care items, wines, alcohols, DIY (Do It Yourself) accessories and the like.

BACKGROUND OF THE INVENTION

Electronic article surveillance labels and RFID labels (collectively referred to as "EAS labels") are known in the art, including U.S. Pat. Nos. 7,023,343, 7,495,566 and 8,093,996 and incorporated herein by reference.

Since the advent of disposable EAS labels in the early 1980s, retailers have applied billions of these small electronic circuits to articles for purchase. The EAS labels were often disguised as fake bar codes onto hard good products in the retail market. In the early days, these labels had an impressive impact on lowering shoplifting as no one could imagine that a bar code label could actually be an electronic anti-shoplifting device that would trigger anti-shoplifting gates at the store's exit points if the goods were not paid for and the EAS label not deactivated.

Little by little and over the years the efficiency of these EAS labels started to erode as shoplifters learned to recognize them and to neutralize them. The most common neutralization method is to simply identify the EAS label and remove the EAS label from the protected goods. EAS label manufacturers responded to the above by (a) shrinking the size of these EAS labels by up to 60% which made them more covert; (b) pre-printing them with security messages such as "Alarm System;" or "Inventory Management;" or "Do Not Remove" to deter shoplifters; and (c) pre-printing the store's logo on the label in order to make believe the EAS label is a marketing label instead of being a security label. However, the efficiency of these EAS labels continued to erode to a point where retailers started to fully wrap the EAS label with adhesive tape when affixed on high shrinkage products such as, but not limited to, cosmetics, perfumes, wines and alcohol, and small DIY products in order to make the process of removing the labels by shoplifters more difficult. This wrapping process increases the effectiveness of an EAS label but has some serious collateral effects for retailers and end users who purchase these items with EAS labels wrapped by adhesive tapes which tapes are sometimes re-enforced in order to prevent them from being cut away (or at least make it more difficult). Such collateral effects include: (a) the time (and expense) of the process of attaching the security label is doubled by the need to apply the security label, then wrap the tape around the article and then cut the tape; (b) for certain products sold in retail, but not limited to, small cosmetics (nail polish, make-up pencils, lip sticks among others) and perfumes, these wrap around labels are time consuming to remove by the end user and they leave glue marks on the product which glue marks degrade the product (these glue marks coming from both the EAS label, which has a very strong permanent glue, and the very strong glue from the wrap-around tape); and (c) certain specialized retailers such as but not limited to, cosmetic and perfume retailers, and pharmacy/drug store retailers, cannot return unsold EAS label protected inventory as the glue from the EAS labels and/or the wrap-around tape damages the goods (at least aesthetically), thereby causing a financial burden to the retailers.

Another problem caused in stores that sell, for example, wines, spirits and the like is that the store personnel often damage the product label when attempting to wrap an EAS label affixed on the product label with standard tape, e.g. a wine label with information about the wine. This is because the store personnel usually need at least two attempts to properly align the tape with the product label, thus needing to peel off the tape from the product label and start again. This "peel off and start again" process usually tears off a part of the product label making the product unsaleable.

Another problem caused in stores such as cosmetic and perfume stores is the fact that such products are often displayed under strong illumination systems which provide substantial heat on the products which may adversely affect the security labels and/or the wrap-around tape, including affecting the integrity of the glue. For example, the illumination heat may worsen the problem of the glue permanently marking/damaging the goods when the EAS label is removed by the customer after purchase of the goods or by the retailer if the goods are not sold and returned to the manufacturer. Additionally, if an EAS label does not have an additional wrap-around tape on a product such as a nail polish or lip stick which are displayed under heavy light and producing excessive heat, the corners or extremities of the EAS labels will start to become unglued making it easier for a shoplifter to determine where the EAS label is located and the heat may affect the merchandising of such products as they may become attached to one another by the exposed glue from the EAS labels.

Another challenge retailers face using EAS labels to protect or trace high shrinkage products are the facts that: the metal used to manufacture certain products, e.g. deodorants made with metal cans; the foil metal used to package certain product, e.g. certain cosmetics and expensive liquors; and the liquid or semi-liquid inside a product, e.g. a wine bottle or a jar for dessert spread, may partially or totally affect the detection or pick-up rate at the EAS detection gates placed after the store checkout point(s). That is, the EAS labels on such protected items may mask the electromagnetic signals emitted by the EAS gates.

Another challenge retailers face using EAS labels to protect or trace high shrinkage products is the fact retail stores and source protection companies which apply the EAS labels may attach the EAS labels to the packaging of the product and not to the product itself. Shoplifters having understood this simply open the package that house the product, such as cosmetics or perfumes, and remove the product and leave an empty package. This can cause collateral damage to honest shoppers who pick up and purchase the product only to find an empty box. This problem has been partly solved by security devices commonly called "Spider Wraps," initially developed by Alpha Security Products, which consist of an electronic alarm with an EAS device that is wrapped around a product using electric cables that emit an alarm when the package is tampered with. However, such devices are expensive and cumbersome to use. For example, small products such as cosmetics and perfumes in many cases are smaller than these devices, requiring a great deal of labor to apply and remove at the point of sale. Another known security device addressing this issue is a clear plastic security box known as a "Safer" wherein an article is locked inside the plastic security box and the box must be opened by a store clerk to remove the article.

As seen above, the current EAS labels for small high value articles have shortcomings. An improved EAS label for such articles is highly desirable. These and other shortcomings of these known EAS labels are addressed by the present invention.

SUMMARY OF THE INVENTION

In order to solve the above challenges with the current EAS labels and wrap-around tape, the invention is directed to a cover label which is used in conjunction with known EAS labels, including RF labels and acousto-magnetic labels such as manufactured and sold by All-Tag Corporation of Boca Raton, Fla.

A primary object of the present invention is to provide an improved EAS label. The term "EAS label" in reference to the present invention is intended to include the cover label and a security element attached to the cover label, that is an EAS label for attachment to an article.

Another primary object of the present invention is to provide an improved EAS label for use with high value hard goods such as, but not limited to, cosmetics, perfumes, medication, health-care items, DIY accessories and the like, referred to herein sometimes as "hard goods."

Another primary object of the present invention is to provide a cover label for use with EAS labels. The term "cover label" in reference to the present invention is intended to include the EAS label of the invention with or without the security element.

Another primary object of the present invention is to provide an improved EAS label which will be easily removable from hard goods without leaving any markings on the hard goods.

Another primary object of the present invention is to provide an improved EAS label and cover label. The cover label may comprise a flexible support having a bottom section and a top section, wherein the bottom section has a width greater than the top section; the bottom section includes a soft glue area for application to a product and an EAS label on the opposite side of the soft glue area of the flexible support; the top section includes a strong glue area to secure the flexible support to the product wherein the flexible support may be wrapped around the product starting with the bottom section being attached to the product with the soft glue area and the wrapping completed with the strong glue of the top section attached to the wrapped flexible support, thereby securing the cover label to the product. Additionally, the EAS label may be placed on the same side of the flexible support as the soft glue area and may incorporate either soft or strong glue to make contact with the hard good.

Another primary object of the present invention is to provide an improved EAS label which is inexpensive to manufacture and easy to apply to a product.

Another primary object of the present invention is to provide an improved EAS label which will not damage the product label to which the EAS label is attached. However, if someone (a shoplifter) attempts to remove the EAS label from the product label, the product label will be damaged thereby making the product less saleable or not saleable. In this embodiment, the EAS label has a bottom section with a soft glue area and the bottom section includes a plurality of openings. The EAS label top section with the strong glue area is attached to the bottom section and it covers the plurality of openings and the strong glue area comes into contact with the product label. If someone removes the EAS label, the strong glue area in contact with the product label will rip or damage the product label, thereby making the product less saleable or not saleable. This EAS label also allows for ease of application of the EAS label with the soft glue area to the product label, e.g. the person applying the EAS label may start over if the bottom section of the label with the soft glue area is not correctly aligned on the product label.

Another primary object of the present invention is to provide an EAS label for attachment to a product label, e.g. a label on a wine bottle. The EAS label includes a bottom section with a soft glue area for starting the attachment of the label to a product label and giving the store personnel the opportunity to peel off the label and start again if he misaligned the EAS label, and a top section having a strong glue area with an EAS label. If the EAS label is removed, the strong glue will rip or otherwise damage the product label making the product less saleable and not saleable, especially if it tears off necessary product information on the product label such as, but not limited to, Tax ID codes.

The present invention is directed to an improved EAS label and cover label comprising a flexible support having a bottom section and a top section; the bottom section having a larger width and shorter length than the top section and including a soft removable glue on a first side of the flexible support; a security element is attached to the bottom section on a second side of the flexible support; and the top section has a smaller width and longer length than the bottom section and has a strong glue area on the first side of the flexible support. Depending on the article to be secured, the bottom section may have a larger width and generally longer length than the top section. The improved EAS label and cover label may further include one or more die cut areas in an intermediate portion of the flexible support for ease of removal of the EAS label from a product.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings:

FIGS. 5A and 5B show the EAS label and cover label of FIG. 2 with a plastic spacer separating the security element from a metal container such that the EAS label and cover label may be used with metal containers or the like.

FIG. 7 shows another alternative embodiment of an EAS label and cover label.

FIG. 8 shows another alternative embodiment of an EAS label and cover label.

DETAILED DESCRIPTION OF THE PREFERRED EMBODIMENTS

Figure 1A:
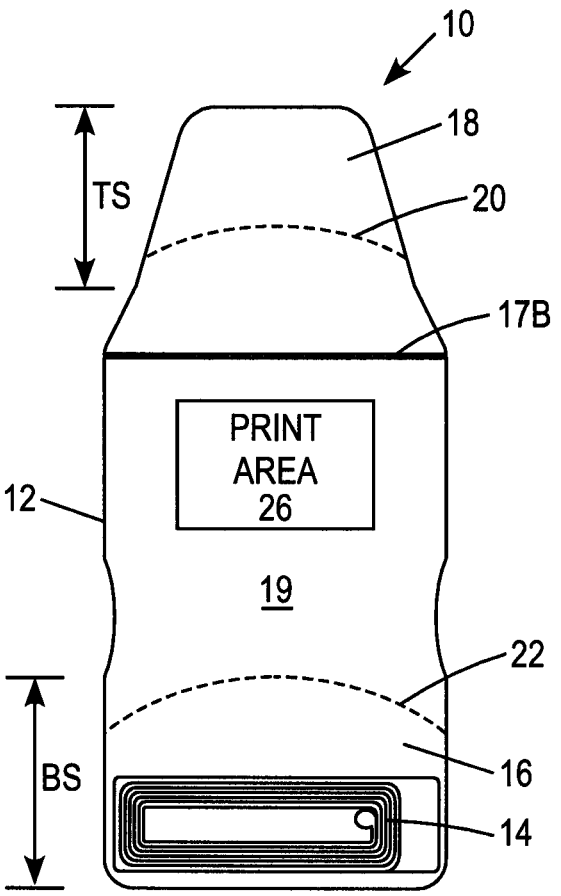
FIG. 1A is a front elevational view of the EAS label and cover label of the present invention with an RF label.
Figure 1B:
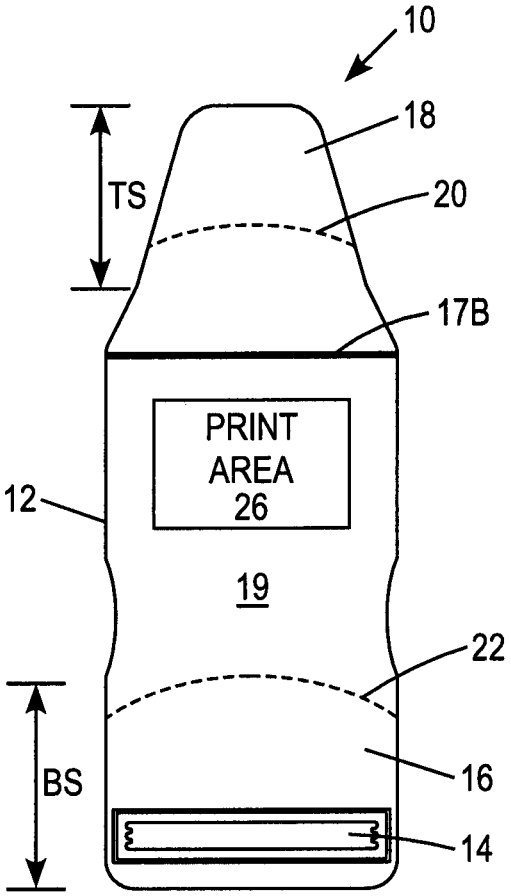
FIG. 1B is a front elevational view of the EAS label and cover label of the present invention with an acousto-magnetic label.
Figure 1C:
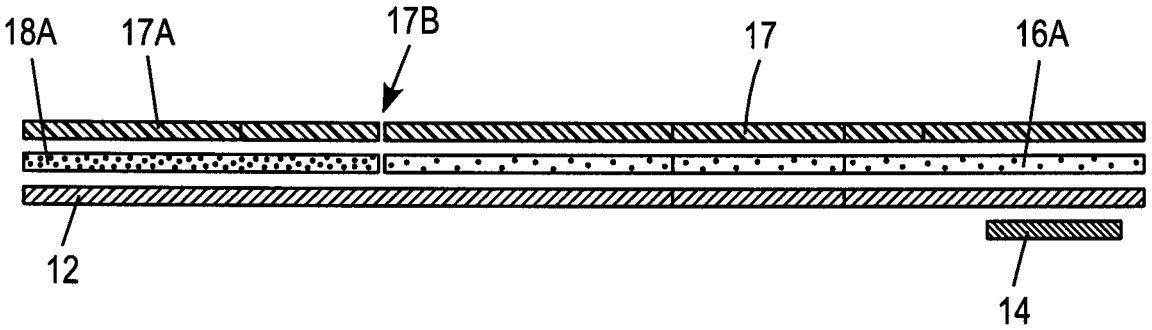
FIG. 1C is a side exploded view of the EAS label and cover label of FIG. 1A.

Referring to FIGS. 1A-1C, there is shown an EAS label and cover label 10 comprising a flexible support 12 to receive a security, identification or traceability element 14, hereafter referred to as a "security element." The security element may include one or a combination of an EAS label; an antenna; or a security device or electronic label such as an RFID element/antenna for the purpose such as, but not limited to, one or multiple traceability, merchandising, marketing, pricing or inventory purposes. FIG. 1A shows the security element 14 as an RF label and FIG. 1B shows the security element 14 as an acousto-magnetic label.

The flexible support 12 may be manufactured from a clear plastic material such as, but not limited to, polypropylene. The flexible support 12 includes a bottom section 16 (BS) having a soft removable glue area 16A designed to make the flexible support 12 hold in place as it is wrapped around a product and to avoid a shoplifter from pushing the flexible support 12 out of a product, e.g. a lip stick. The soft removable glue area 16A may cover all or a portion of the bottom section 16. A presently preferred soft glue is Avery Removable Adhesive, which glue will not leave any trace when the cover label is removed from the product. The soft glue area may include a peel-off paper 17 for storage and ease of application. A top section 18 (TS) having a strong glue area 18A is located at the top of label 10. The strong glue area 18A may cover all or a portion of the top section 18. A presently preferred strong glue is UPM Permanent Adhesive. This strong glue area is used to securely attach the cover label 10 to the product once it has been wrapped around the product. The strong glue area may include a peel-off paper 17A for storage and ease of application. As shown in FIG. 1C, the peel-off papers 17 and 17A are two separate papers overlying the entire flexible support 12 and meeting at 17B, although one or more peel off papers may be used. It is understood that other soft and strong glues may be used without departing from the scope of the invention.

A special shape cover label 10 is used to avoid the strong glue area from ever coming into contact with the product or the security element. More specifically and referring to FIGS. 1A and 1B, this shape may comprise (a) a smaller area/section 18 at the top extremity where the strong glue is located; and (b) a larger area/section 16 at the base/bottom of the flexible support where the soft glue area is located. While (a) and (b) are sufficient, a preferred embodiment includes an intermediate area 19 as large as the bottom area which ensures that the top area does not come into contact with the product while the cover label is being rolled onto the product. This intermediate area may also include a soft glue area as shown in FIG. 1C, although it is not necessary. However, other shapes of the cover label may achieve the same purpose. In general, the top section 18 of the cover label 10 is of a smaller area than the bottom section 16, thus when rolling the label around the product, the top section 18 will not touch the product being wrapped with the cover label.

Referring again to FIGS. 1A and 1B, optional die cut lines 20 and 22 comprising perforations may be provided to make it easier for the store personnel or the end user to remove the cover label without damaging the product which the security element 14 is affixed to. The security element 14 is attached to the side of the flexible support opposite that of the soft glue area. In the alternative, the security element 14 may be attached to the side of the flexible support having the soft glue area. Additionally, a print area 26 may be provided where a logo, deterrent or promotional message may be printed.

Figure 3:
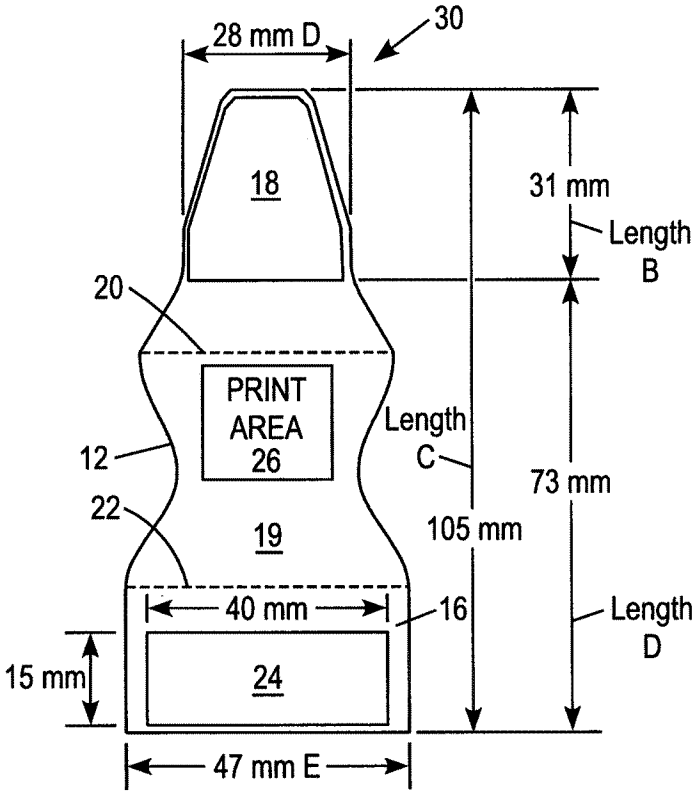
FIG. 3 is a front elevational view of the cover label of the EAS label of FIG. 2 and without the security element.
Figure 2:
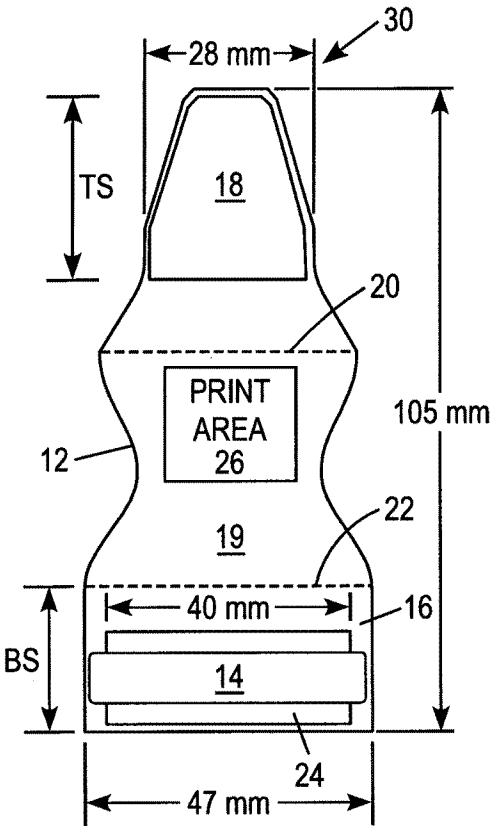
FIG. 2 is a front elevational view of another embodiment of the EAS label and cover label of the present invention.

Referring to FIG. 2, there is shown an EAS label and cover label 30 similar to EAS label and cover label 10 having a slightly different shape and showing sample dimensions and wherein like numerals to EAS label and cover label 10 are used to describe the EAS label and cover label 30. FIG. 3 shows the EAS label and cover label 30 of FIG. 2 without the security element. This EAS label and cover label includes a flexible support 12 to receive a security element 14. The flexible support 12 includes a bottom section 16 (BS) having a soft removable glue area (not shown) designed to make the flexible support 12 hold in place as it is wrapped around a product and to avoid a shoplifter from pushing the flexible support 12 out of a product, e.g. a lip stick. The soft glue area may include a peel-off paper (not shown) for storage and ease of application. A top section 18 having a strong glue area is located at the top of label 30. This strong glue area is used to securely attach the cover label 30 to the product once it has been wrapped around the product. The strong glue area may also include a peel-off paper (not shown) for storage and ease of application.

Like EAS label and cover label 10, a special shape cover label 30 is used to avoid the strong glue area from ever coming into contact with the product or the security element. More specifically and referring to FIGS. 2 and 3, this shape may comprise (a) a smaller area/section 18 at the top extremity where the strong glue is located; and (b) a larger area/section 16 at the base/bottom of the flexible support where the soft glue area is located. While (a) and (b) are sufficient, a preferred embodiment includes an intermediate area 19 as large as the bottom area which ensures that the top area does not come into contact with the product while the cover label is being rolled onto the product. This intermediate area may also include soft glue, although this is not necessary. However, other shapes of the cover label may achieve the same purpose. In general, the top section 18 of the cover label 30 is of a smaller area than the bottom section 16, thus when rolling the label around the product, the top section 18 will not touch the product being wrapped with the cover label.

Referring again to FIGS. 2 and 3, optional die cut lines 20 and 22 comprising perforations may be provided to make it easier for the store personnel or the end user to remove the cover label without damaging the product which the security element 14 is affixed to. Further, a nesting area 24 for the security element may be included and which may be marked with a visual indication for the security element. The security element 14 is attached to the side of the flexible support opposite that of the soft glue area. In the alternative, the security element 14 may be attached to the side of the flexible support having the soft glue area. Additionally, a print area 26 may be provided where a logo, deterrent or promotional message may be printed.

Referring to FIGS. 1-3, there are shown presently preferred embodiments of the EAS label and cover label. The shape and dimensions of the EAS label and cover label of the invention may be adjusted to the article to which the label is to be applied. However, it is understood that other shapes and dimensions may be utilized without departing from the scope of the invention.

Figure 4A:
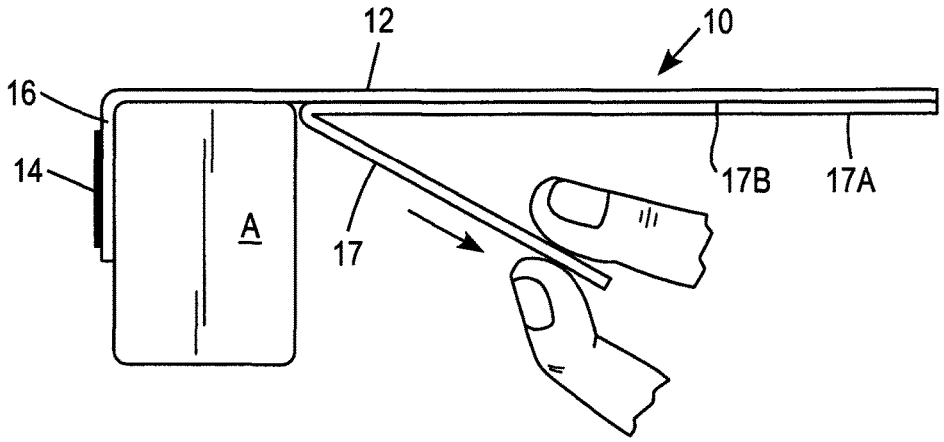
FIGS. 4A-4D show the attachment of the EAS label and cover label of FIG. 1 to an article.
Figure 4B:
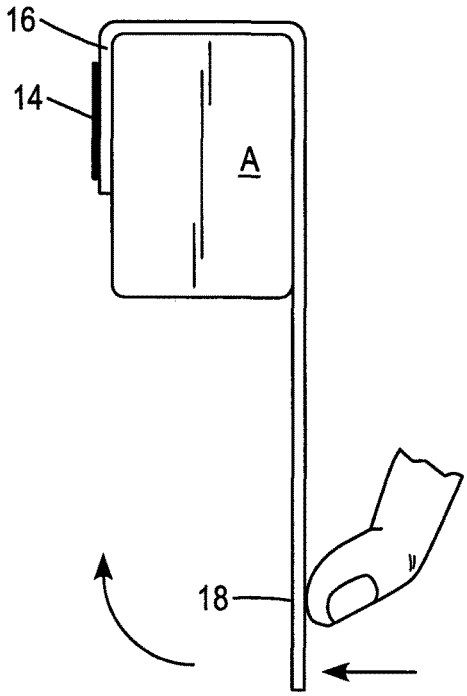
Figure 4C:
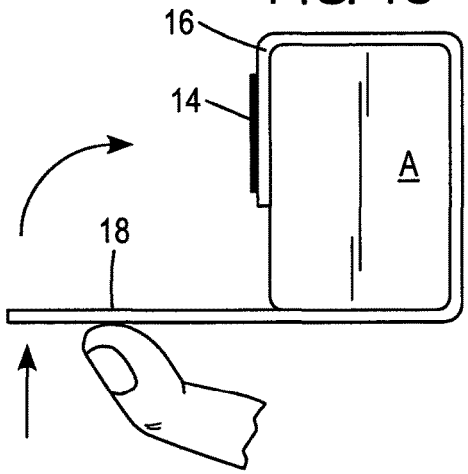
Figure 4D:
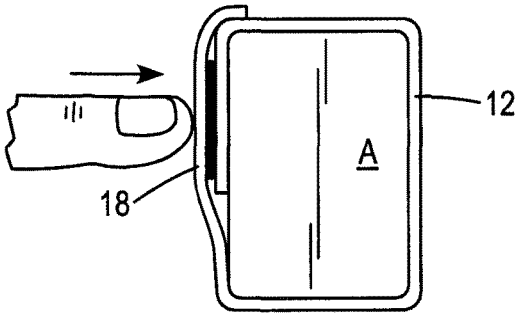

FIGS. 4A-4D show an article A, e.g. an eyelash and eyebrow conditioner article, being wrapped with an EAS label and cover label 10 with flexible support 12 and having a security element 14. In FIG. 4A, the bottom area 16 having the soft glue area is attached to article A. The security element 14 is on the opposite side of the soft glue area. The peel-off paper layers 17 and 17A may be removed in their entirety before attaching the label 10 to the article A or removed as the label is being attached. Referring to FIGS. 4B and 4C, the EAS label is shown being wrapped around the article A. Referring to FIG. 4D, the peel-off paper 17A has been removed and the top section 18 with the strong glue area is attached to the outside of the flexible support 12 and covering the security element 14. It is understood that this top area may be wrapped further around article A and may be attached to other portions of the flexible support 12 at different locations of article A.

It is understood that an EAS label and cover label may be sized to fit around the entire package of an article, e.g. a package for skin cream, to prevent a shoplifter from opening the package, removing the article and closing the package. In such instance, the cover label is transparent allowing the consumer to see all of the pertinent branding information and product information. The cover label is removed by perforations which allow for easy removal of the cover label.

Figure 5A:
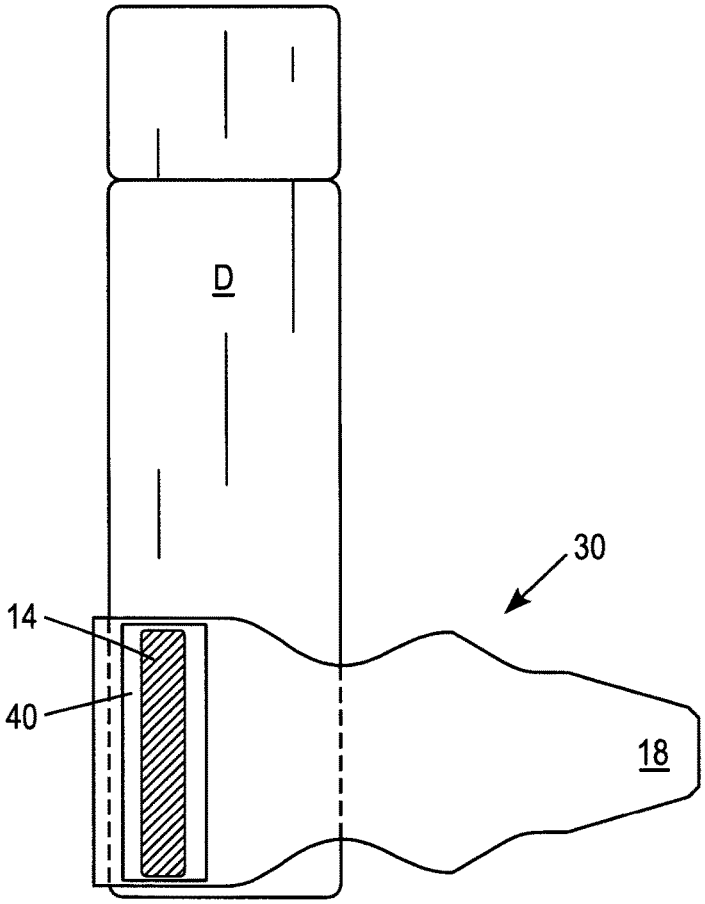
Figure 5B:
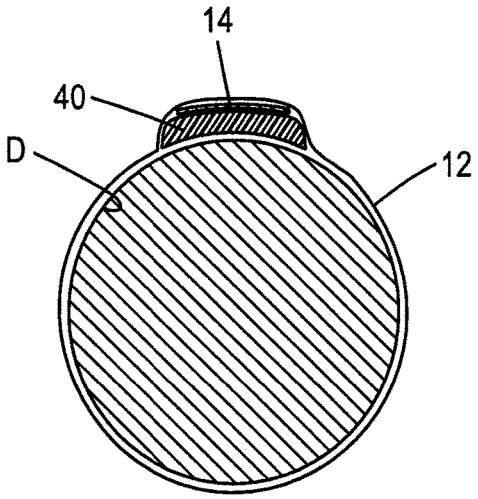

Referring to FIGS. 5A and 5B, there is shown an embodiment of the cover label 10 such as shown in FIGS. 1A, 1B and 2 and further including a plastic spacer 40 which separates the security element 14 from the article D, in this case a metal can of deodorant. The plastic spacer may be used when the article is made of metal or has a metal foil or contains a liquid or semi-liquid. This helps space the security element from the metal, the metal foil or the liquid/semi-liquid. This precludes such materials from interfering with the security element detection by the EAS gates. The plastic spacer 40 may be made of a flexible plastic such as, but not limited to, rubber.

Figure 6A:
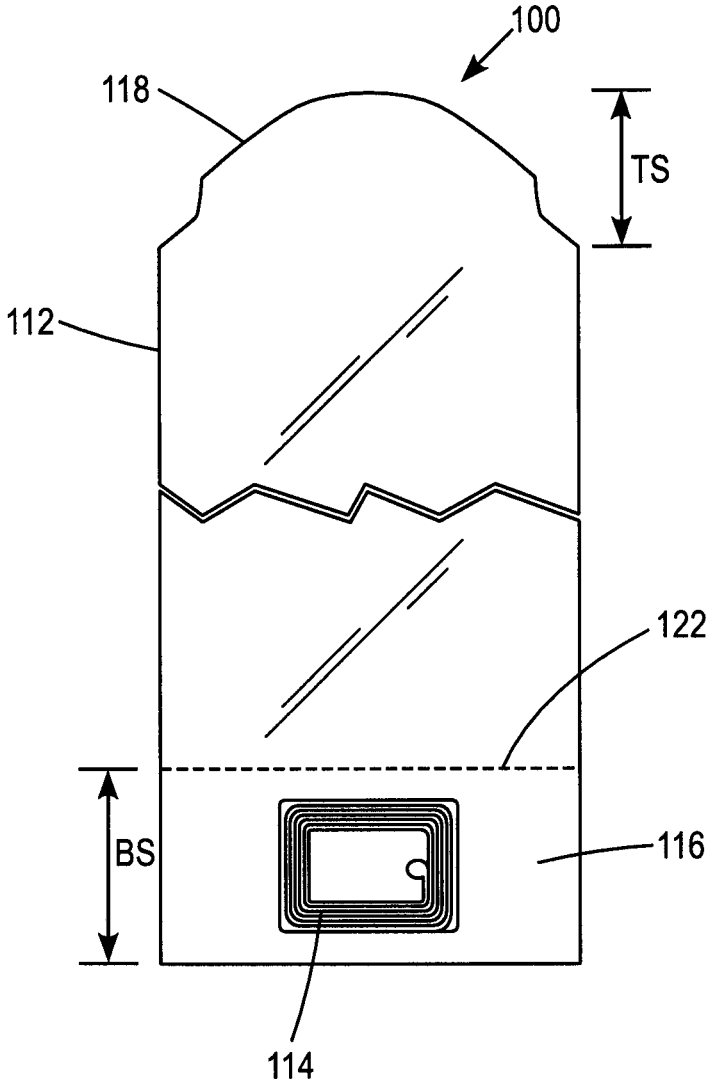
FIG. 6A shows an alternative embodiment of an EAS label and cover label wherein the security element may be secured inside of an article.
Figure 6B:
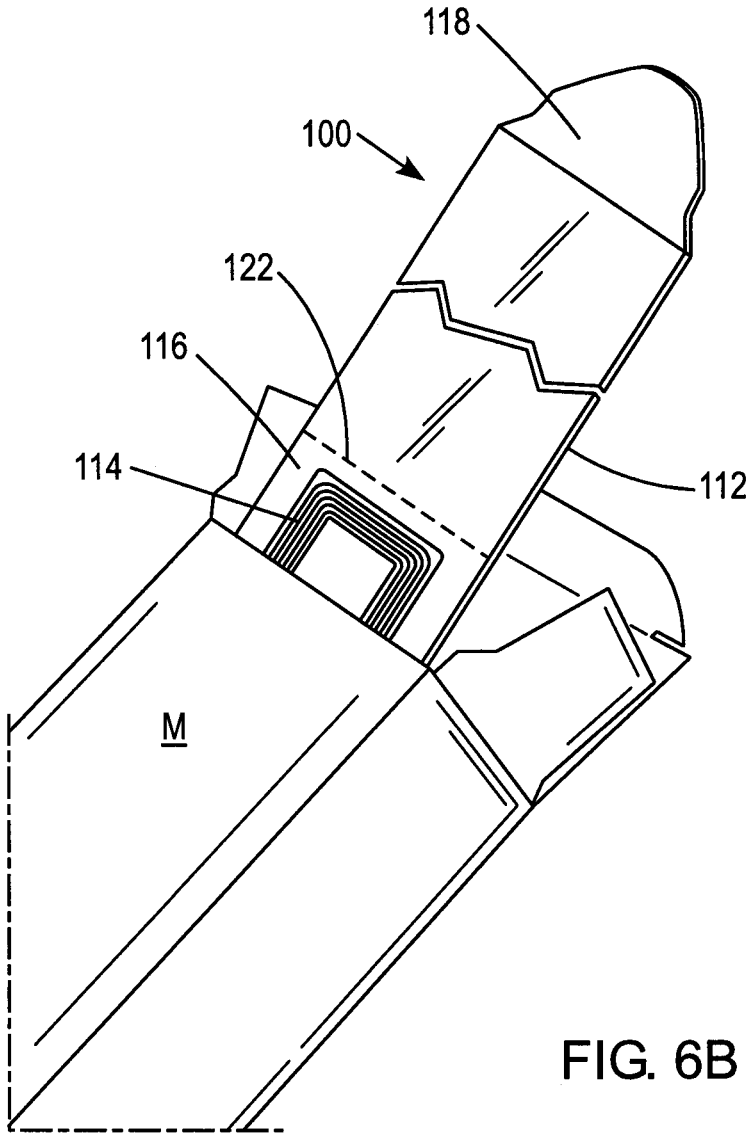
FIG. 6B shows the EAS label of FIG. 6A being attached to an article.

Referring to FIGS. 6A and 6B, there is shown an alternative embodiment of the EAS label and cover label. In this embodiment, the security element is attached to the inside of an article M such as, but not limited to, a cardboard box carrying a medication. This embodiment includes an EAS label and cover label 100 having a flexible support 112. The cover label may be of a substantially equal width throughout and which width may correspond to that of article M. The cover label 100 includes a security element 114 having a permanent adhesive thereby allowing the security element 114 to be securely attached to the inside of the article M. The security element 114 is attached to the cover label by either a soft glue or a strong glue. This soft glue or strong glue may also be used to secure the cover label to the inside article M. In this example, security element 114 is an RF label. The cover label 100 will include perforation lines 122 and a top section 118 having a strong glue area and having a width less than the main portion of flexible support 112. In use, the cover label 100 is attached to the inside of the article M by the permanent adhesive of the security element 114 and may also be attached by either a soft glue or a strong glue of the cover label. The perforations 122 are generally at the outside of the article M and the cover label is wrapped fully around the article M such that the top section 118 of the cover label having a strong glue area will adhere to the wrapped cover label thereby not interfering with the packaging of the article M. The cover label 100 is transparent such that all of the information on the article M is readable and is not interfered with by the cover label. The cover label will thereby preclude a shoplifter from opening the article M as the end of the packaging of article M is covered by the cover label. To the extent that a shoplifter attempts to remove the cover label 100, the cover label will break at perforations 122 thereby leaving the security element 114 secured to the inside of the box.

Referring to FIG. 7, there is shown another alternative embodiment of the EAS label and cover label. In this embodiment, the EAS label and cover label is intended to be wrapped around a product such as a jar and cover the product label. If the EAS label is removed from the product, the product label will be damaged, thereby making the product not saleable or less saleable in a subsequent market, especially if important product information on the label is removed. This embodiment includes an EAS and cover label 200 having a flexible support 212 having a first side and a second side. The bottom section 216 of the label is substantially uniform in width for wrapping around a product. The bottom section 216 includes a soft glue area on the first side of the flexible support 212 and the soft glue area may extend throughout the bottom section which is to be wrapped around the product or just at a beginning portion of the bottom section. There is a security element 214 on the opposite side of the soft glue area at the bottom section 216. At the bottom section 216, there are a plurality of openings 220, e.g. annular openings, exposing a product label of the product. There is a top section 218 having a strong glue area on the first side of support 212 and having a width narrower than bottom section 216. In use, the label is wrapped around a product, e.g. a jar, with the soft glue area being attached to the product. The soft glue area allows the user to start over in applying the EAS label if it is not properly aligned without damaging the product label. The top section 218 with the strong glue area will cover the security element 214 and the plurality of openings 220, thereby attaching the EAS label 200 to the product. The strong glue area will be in contact with the product label through the openings 220. The cover label 200 may have one or more peel-off papers covering the soft and strong glue areas. If someone tries to take the EAS label 200 off of the product, the strong glue area having adhered to the product label will tear and damage the product label. The product, therefore, will be less saleable or not saleable in a subsequent market as a consumer may not wish to purchase damaged goods, especially if the EAS label with the openings is placed over important product information on the product label.

Referring to FIG. 8, there is shown another alternative embodiment of the EAS label and cover label. In this embodiment, the EAS label and cover label is preferably transparent and used on a product such as a wine bottle and attached to the label of the product. This embodiment includes an EAS label and cover label 300 having a flexible support 312. The cover label may be of substantially equal width throughout (although other shapes may be used) and is not intended to wrap around the product but to be attached to a label of the product. For example, the EAS label and cover label may be in the range of 10 cm to 15 cm. The cover label 300 includes a bottom section 316 having a soft glue area and a top section 318 having a strong glue area.

Attached to the strong glue area of the top section 318 is a security element 314. The cover label 300 may have one or more peel-off papers to cover the soft and strong glue areas (not shown). In use, the peel-off papers are removed, and the soft glue area is aligned with a portion of the product label. Once the cover label 300 is attached in a neat manner, the strong glue area with the security element 314 is attached to the product label, the security element 314 being covered by the flexible support 312. If the cover label 300 is attempted to be removed by a shoplifter, the strong glue area will tear and damage the product label, thereby making the product less saleable or not saleable in a subsequent market as a consumer may not wish to purchase damaged goods, especially if the cover label covers important product information.

The EAS labels and cover labels of the invention have been described above as having peel-off paper to cover the glue areas for storage of multiple labels and providing to the customer. In the alternative, the EAS labels may be stored on a roll with the glue areas being attached to a paper backing and a space between each EAS label for tearing and subsequent application of the EAS label. In the alternative, the paper backing may include perforations for ease of removal of the EAS label from the roll of EAS labels.

Accordingly, the EAS label and cover label invention may include the following attributes:

A. a flexible cover label to be wrapped around a product comprised of at least two different types of glues in two distinct areas and comprising (1) a strong permanent glue in one area to secure the cover label onto the product once it has been totally wrapped around the product, and (2) a soft removable glue in a second area that leaves no traces when removed from the product and to assist the user to position the cover label onto the product while it is being wrapped and to prevent the cover label from sliding from one side to the other on the product after the cover label has been secured to the product.

B. a flexible cover label that when removed leaves no traces of glue on the product as the area of the cover label that contains the strong glue will not come into contact with the product.

C. a flexible cover label using two different glues to be wrapped around a product wrapping in a sandwich a security element such as, but not limited to, an EAS label; an RFID label; a bar code or QR code label; a Tx, Rx or TRX antenna; or a printed visual ID image, number, code or similar image. This sandwich configuration is when the security element is on the side of the cover label opposite the soft glue area.

D. a flexible cover label using two different glues to be positioned on a product whereas the strong glue area and the soft glue area are protected by a removable peel-off paper in order to stack multiple cover labels in one container without the glues of surrounding cover labels making contact with the stacked labels. The peel-off papers also provide for ease of application for an operator when wrapping the cover label onto a product by removing the peel-off paper from the bottom of the label to expose the soft glue; positioning the cover label onto the product; wrapping the cover label around the product; and removing the peel-off paper at the top of the cover label to expose the strong glue and secure the cover label in place on the product.

E. a flexible cover label as shown, for example, in FIGS. 1 and 2 using two different glues to be positioned on a product whereas the strong glue will not accidentally, including through error in application, come into contact with the product due to the special shape of the cover label defined by (1) a top area where the strong glue is located which is smaller in width than the bottom area where the soft glue is located; and a top area where the strong glue is located which may be longer in length than the bottom area.

F. flexible cover labels of different lengths, as shown for example in FIG. 3, use two different glues (strong permanent glue and soft removable glue) of a particular length C=(A+B) to be positioned on a product whereas length A shall be the maximum circumference of a product where a cover label can be wrapped to guarantee that the strong glue does not contact the product.

G. a flexible cover label using two different glues (strong permanent glue and soft removable glue) with a special shape which will prevent the strong glue from touching the product once the cover label is wrapped around the product. In the example of FIG. 3, the width D is smaller than width E and more specifically, for example, E=47 mm and D=28 mm to ensure that the strong glue will always end matching the surface of the cover label when totally wrapped around the product. As long as the width of D is smaller than the width of E there cannot be a wrapping error, thereby preventing the area with the strong glue from contacting the product.

H. a flexible cover label using two different glues to be positioned on a product (strong permanent glue and soft removable glue) wherein the security element will be completely covered by the material of the flexible cover label in order to avoid the glue on the extremities of the security element from coming into contact with other articles or products in the retail display environment.

I. a flexible cover label using two different glues to be positioned on a product (strong permanent glue and soft removable glue) wherein the security element will never touch the product it is affixed to as it will always be "sandwiched" between two layers of the cover label. This sandwich configuration is when the security element is on the side of the cover label opposite the soft glue area.

J. a flexible cover label using two different glues to be positioned on a product as referenced above that is long enough to be wrapped around the entire perimeter of a packaged product such as, but not limited to, cosmetic products thus locking the access to remove the product from its packaging to potential shoplifters without affecting the product's design and branding and/or hiding or covering important customer information as the cover label is transparent and the cover label will not leave any adhesive mark or trace after being removed.

K. a flexible cover label to be wrapped around a product or packaging as referenced above and shown in FIGS. 5A and 5B wherein a spacer element is used to separate the security element from the product or packaging having metal, metal foil or liquid/semi-liquid. Such spacer may be constructed from a flexible, non-metallic material such as a flexible transparent polymer to adopt the shape of the product it will be wrapped around such as a bottle of wine, small cosmetic or deodorant. Such spacer affixed on the cover label will carry on one side the EAS element and will have a thickness of between a few millimeters to a few centimeters, preferably less than 4 cm depending on the EAS label used and on the type of product it is wrapped around. The more metal or metal foil or liquid/semi-liquid a product contains the thicker the spacer may need to be. The spacer may be designed to be re-used after being removed by having a pocket in the cover label for holding the spacer.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. An EAS label for attachment to an article by wrapping the EAS label at least partially around the article comprising a flexible support having a first side, a second side, a bottom section and a top section; the bottom section having a larger width than the top section and including a soft removable glue area on the first side of the flexible support and said soft removable glue area is adapted to be attached to the article when starting to wrap the EAS label around the article; a security element is attached to the bottom section on the first side or the second side of the flexible support; and the top section has a smaller width than the bottom section and has a strong glue area on the first side of the flexible support, wherein the flexible support is adapted to be wrapped at least partially around the article starting with the bottom section of the flexible support.

2. The EAS label of claim 1 wherein the bottom section has a shorter length than the top section.

3. The EAS label of claim 1 wherein said flexible support further includes an intermediate section between said bottom section and said top section.

4. The EAS label of claim 2 wherein said flexible support further includes an intermediate section between said bottom section and said top section.

5. The EAS label of claim 3 wherein said intermediate area includes a soft removable glue area on said first side of said flexible support.

6. The EAS label of claim 1 wherein said security element comprises one or a combination of an EAS label, an antenna and an RFID element.

7. The EAS label of claim 1 further including a peel-off paper covering at least said soft removable glue area and said strong glue area.

8. The EAS Label of claim 7 wherein said EAS label includes at least one set of perforations.

9. The EAS label of claim 8 wherein the peel-off paper overlies the entire flexible support.

10. The EAS label of claim 1 wherein the security element is attached to the second side of said flexible support.

11. The EAS label of claim 1 wherein the flexible support includes a nesting area for said security element.

12. The EAS label of claim 1 wherein the flexible support includes a print area and a printed message in the print area.

13. The EAS label of claim 1 further comprising a spacer between the second side of said flexible support and said security element.

14. The EAS label of claim 1 wherein said flexible support is made of plastic.

15. The EAS label of claim 1 further comprising a plurality of openings at said bottom section and adapted to be covered by said strong glue area of said top section.

16. A method for attaching an EAS label to an article wherein the EAS label comprises a flexible support having a first side, a second side, a bottom section and a top section; the bottom section having a larger width than the top section and including a soft removable glue area on the first side of the flexible support; a security element is attached to the bottom section on the first side or the second side of the flexible support; and the top section has a smaller width than the bottom section and has a strong glue area on the first side of the flexible support, comprising the steps of applying the first side of the bottom section of the EAS label having the soft removable glue area to the article and wrapping the EAS label around the article and securing the EAS label to the second side of the wrapped EAS label by the strong glue area of the top section of the EAS label.

17. The method of claim 16 wherein the security element is attached to the second side of said flexible support and said flexible support further includes an intermediate section between said bottom section and said top section and said intermediate area includes a soft removable glue area on said first side of said flexible support.

18. The method of claim 17 wherein said security element comprises one or a combination of an EAS label, an antenna and an RFID element.

19. The method of claim 18 further including a peel-off paper covering at least said soft removable glue area and said strong glue area.

20. An EAS label for attachment to an article comprising a flexible support having a first side, a second side, a bottom section and a top section; the bottom section having a soft removable glue area on the first side of the flexible support and adapted to engage the article; the top section having a strong glue area on the first side of the flexible support and adapted to engage the article; and a security element is attached to the top section on the first side of the flexible support.

* * * * *